US006112942A

United States Patent [19]

Deacon

[11] Patent Number: 6,112,942

[45] Date of Patent: Sep. 5, 2000

[54] TABLET DISPENSING CAP

[75] Inventor: Gordon D. Deacon, Telford, Pa.

[73] Assignee: Merck & Co., Inc., Rahway, N.J.

[21] Appl. No.: 09/018,109

[22] Filed: Feb. 3, 1998

Related U.S. Application Data

[60] Provisional application No. 60/039,482, Feb. 28, 1997.

[51] Int. Cl.[7] ..... B65G 59/00

[52] U.S. Cl. ..... 221/266; 222/368; 221/155

[58] Field of Search ..... 221/5, 263, 264, 221/265, 266, 155, 277; 222/368

[56] References Cited

U.S. PATENT DOCUMENTS

| | | | |
|---|---|---|---|
| 1,891,817 | 12/1932 | Hildebrand | 221/266 |
| 2,029,056 | 1/1936 | Carlson | 221/266 |
| 3,161,321 | 12/1964 | Mellion et al. | 221/5 |
| 3,204,834 | 9/1965 | Gadenne | 222/368 |
| 3,276,636 | 10/1966 | Johnson, Jr. | 221/266 |
| 3,323,688 | 6/1967 | Silver, Jr. et al. | 221/266 |
| 3,921,851 | 11/1975 | Nilson | 221/265 |
| 4,285,448 | 8/1981 | Group | 222/368 |
| 4,412,625 | 11/1983 | Zander | 215/223 |
| 4,428,502 | 1/1984 | Veltri | 221/152 |
| 4,460,106 | 7/1984 | Moulding, Jr. et al. | 221/1 |
| 4,522,313 | 6/1985 | Jennings et al. | 222/1 |
| 4,828,143 | 5/1989 | Jennings | 221/266 |
| 4,957,219 | 9/1990 | Robbins et al. | 222/368 |

*Primary Examiner*—Andres Kashnikow
*Assistant Examiner*—Jorge Bocanegra
*Attorney, Agent, or Firm*—Dianne Pecoraro; Mark R. Daniel; Elliott Korsen

[57] ABSTRACT

A tablet dispensing cap that allows an individual who is elderly, infirm, handicapped or visually impaired to dispense a single, non-liquid form through a single-handed operation.

6 Claims, 5 Drawing Sheets

TABLET DISPENSING CAP

This application claims the benefit of U.S. Provisional Application 60/039,482, filed Feb. 28, 1997.

BACKGROUND OF THE INVENTION

Persons with temporary or permanent physical disabilities face numerous challenges to their independence. These challenges are especially great when the disabilities involve the use of the fingers and hands. Such disabilities may include, but are not limited to, deformation of hands or fingers, and damage to hand or finger muscles, bones, tendons or nerves. The disability may be caused by something as ordinary as arthritis or something more unusual, such as cerebral palsy or the loss of one or more fingers. Individuals who are visually impaired may also have difficulty in dispensing a single dose without assistance. The disabled frequently have a particularly difficult time in opening containers and dispensers, such as medicine or vitamin bottles, and dispensing a single dose. Generally, such containers and dispensers must be manually opened and have wide mouths which make it difficult to dispense one tablet or capsule at a time.

Single dose dispenser has been disclosed in several patents, such as U.S. Pat. Nos. 3,276,636 and 3,323,688. U.S. Pat. No. 4,412,625 discloses a child-proof container for the handicapped. However, many of the prior art devices require complex mechanizations or the use of two hands. Other devices require manual strength to dispense the tablet. This is particularly difficult for the elderly, infirm or handicapped who cannot assert the necessary pressure.

It is accordingly an object of the present invention to provide a dispensing cap that allows an individual to dispense a single non-liquid form by a single-handed operation that requires only a slight amount of pressure.

An additional object of the present invention is to provide a dispensing cap that allows the visually impaired in dispensing a single non-liquid form.

Another object of the present invention is to provide a reusable dispensing cap that is compatible with any container having a similar diameter.

SUMMARY OF THE INVENTION

The present invention relates to a tablet dispensing cap that dispenses one non-liquid form at a time. This invention alleviates the drawback of the background art inventions by providing a simple device that requires a minimal amount of pressure. Therefore, this device can be operated with the use of one hand.

The invention relates to a cap for dispensing a single, non-liquid form comprising:

a circular base having a mouth and a channel, the mouth narrowing into said channel, which is located in the center of the base, the channel being larger in size than the single non-liquid form;

two cantilevered spring arms annularly protruding from the base, away from the mouth, each spring arm terminating in a hooked end;

a circular shaped hub having a plurality of cavities formed on the periphery of the hub, each cavity having rounded edges, said cavity being larger in size than the single, non-liquid form, the hub fitting securely within the annularly positioned spring arms such that the hub and spring arms lie in the same plane and the cavity can be aligned with the channel in the base, the cavity being locked into place when the rounded edges of the cavity are secured by the hooked ends of the spring arms;

two discs, each disc characterized by having multiple scallops along the entire periphery of the disc, the discs having a larger diameter than the hub, the center of each disc being attached to the center of one side of the hub such that the disc is parallel to the hub and spring arms and, together, the discs sandwich the hub and the spring arms.

Still other objects and advantages of the present invention will become readily apparent to those skilled in this art from the following detailed description, wherein only the preferred embodiment of the invention has been shown, simply by way of illustration of the best mode contemplated. As will be realized, the invention is capable of modifications in various aspects, all without departing from the invention. Accordingly, the drawings and description are to be regarded as illustrative in nature, and not as restrictive.

BRIEF DESCRIPTION OF THE DRAWINGS

The present invention may be described with greater clarity and specifically with reference to the drawings, in which.

DETAILED DESCRIPTION OF THE INVENTION

Figure 2:
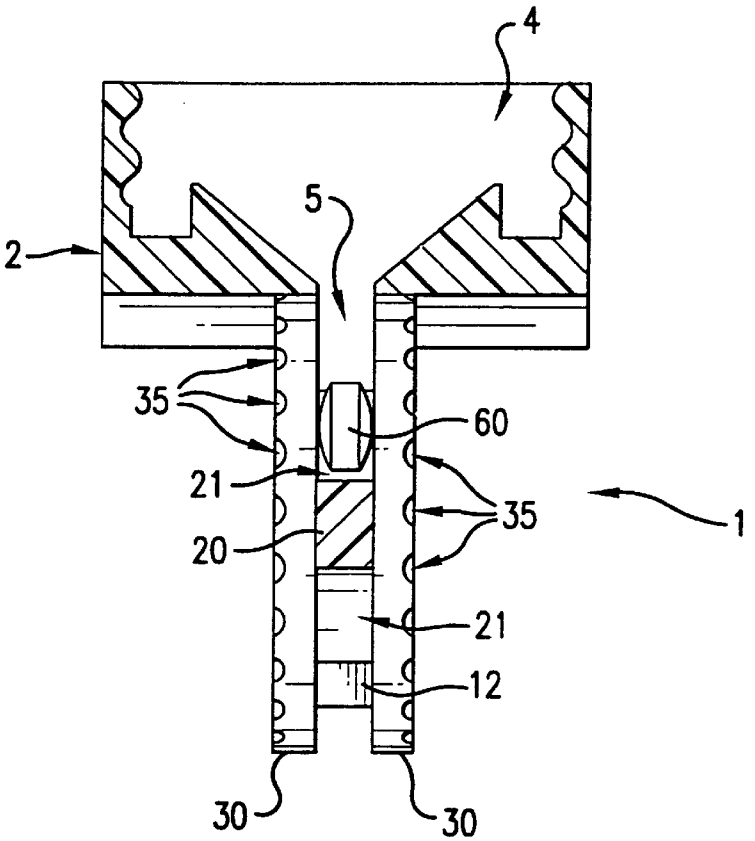
FIG. 2 is a cross-sectional side view of the preferred embodiment of the invention.
Figure 1:
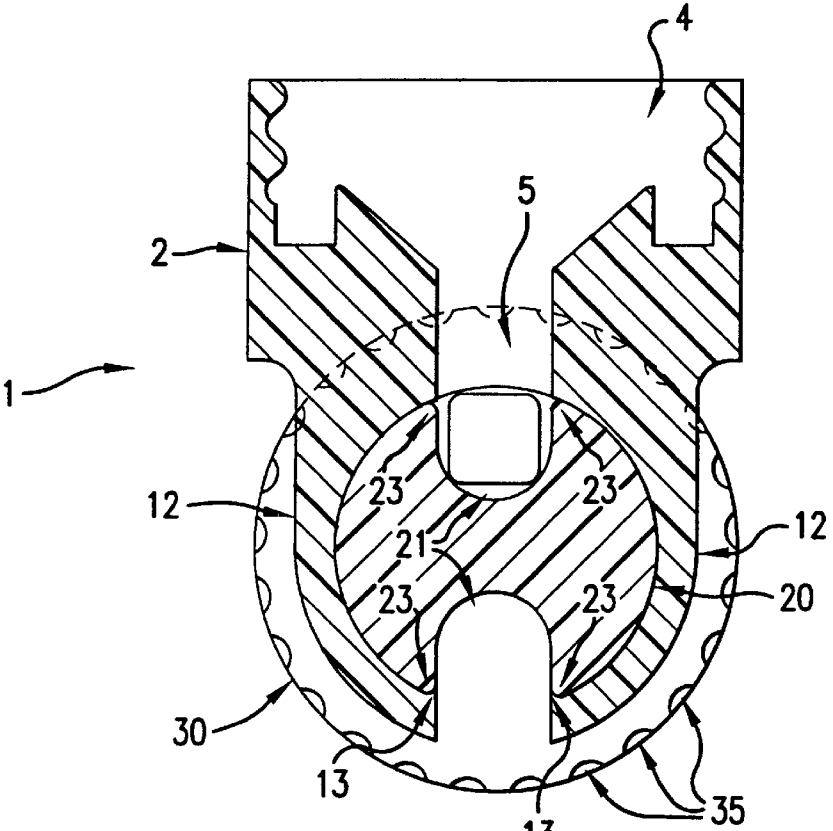
FIG. 1 is a view in perspective of the preferred embodiment of the invention.
Figure 3:
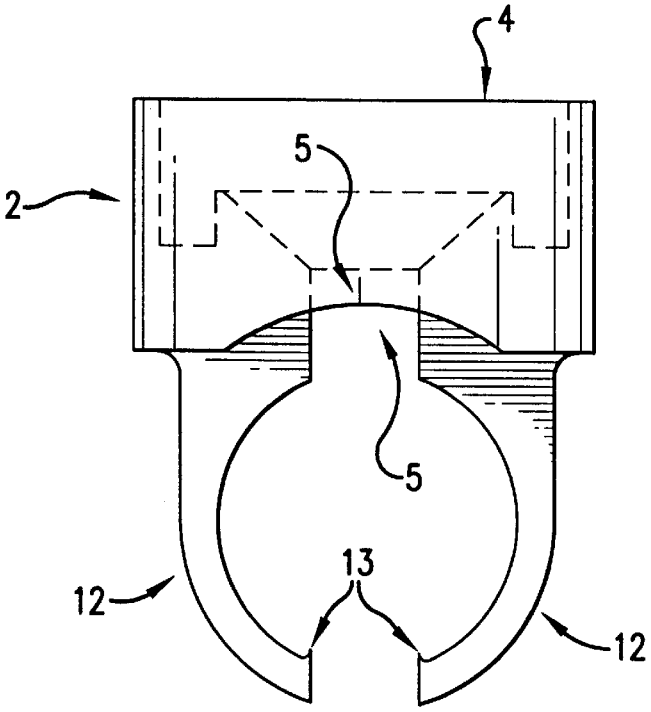
FIG. 3 is a perspective view of the base and spring arm combination.

Referring more particularly to the drawings, wherein like numbers designate like parts throughout, FIG. 1 represents the invention, as assembled, in two dimensions. The cap (1) broadly comprises a base (2), two spring arms (12), a hub (20) and two discs (30). The base (2) has a mouth (4), which narrows into a channel (5) that is located in the middle of the base (2). This channel (5) is large enough to allow a single non-liquid form to pass through. As used hereinafter, the phrase "non-liquid form" may include, but is not limited to, tablets, pellets, caplets or capsules. Examples of such non-liquid forms may include drugs, vitamins, candy or any other suitable non-liquid form whose shape can be accommodated by the cap. The mouth (4) of the base (2) may be flared or tapered. The inside walls of the base (2) can be molded to have screw threads or to be smooth. If the walls are smooth, a threaded insert may be affixed or the cap (1) can be made to snap onto a container. As shown in FIG. 3, two cantilevered spring arms (12) are annularly molded on the base (2). The spring arms (12) are preferably molded from the same piece of plastic as the base (2) and are considered one unit. Alternatively, the spring arms (12) may be separate pieces that are affixed to the base (2). Each spring arm (12) terminates in a hooked end (13).

Figure 4:
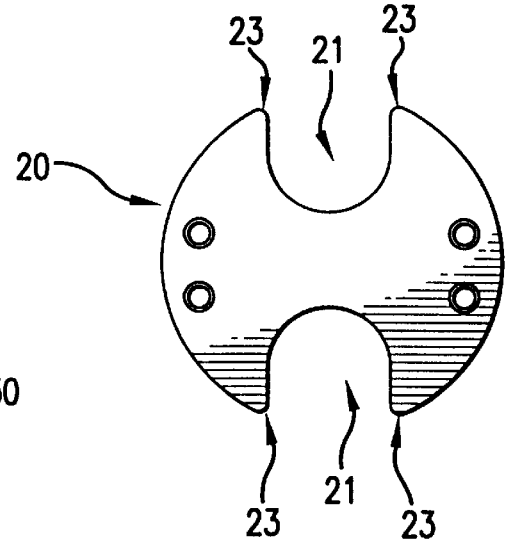
FIG. 4 is a perspective view of the hub.

As shown in FIG. 4, the hub (20) is circularly shaped and on the periphery of the hub (20) are cavities (21), which are large enough to accommodate a single, non-liquid form. Each cavity (21) has rounded edges (23) at its outer surface.

The hub (20) is securely fitted within the annular spring arms (12) such that the hub (20) and spring arms (12) are in the same plane.

Figure 5:
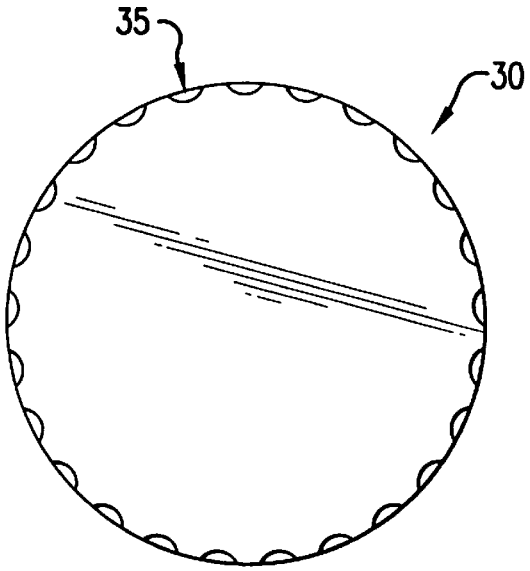
FIG. 5 is a perspective view of a disc.

Circular discs (30) are used to sandwich the hub (20) and spring arm (12) combination. As shown in FIG. 5, each disc (30) has multiple scallops (35) along its entire periphery. The scallops (35) provide a means for easily gripping and rotating the discs (30) with one hand. The two discs (30) have the same diameter, said diameter being larger than the diameter of the hub-spring arm combination. The center of each disc (30) is affixed, on opposite sides, to the center of the hub (20). The discs (30) may be affixed to the hub (20) by several methods, including, but not limited to, glue, screws, rivets or by welding. In a preferred embodiment of the invention, the discs (30) are transparent to allow for visual confirmation that the non-liquid form is positioned in the cavity.

Figure 6:
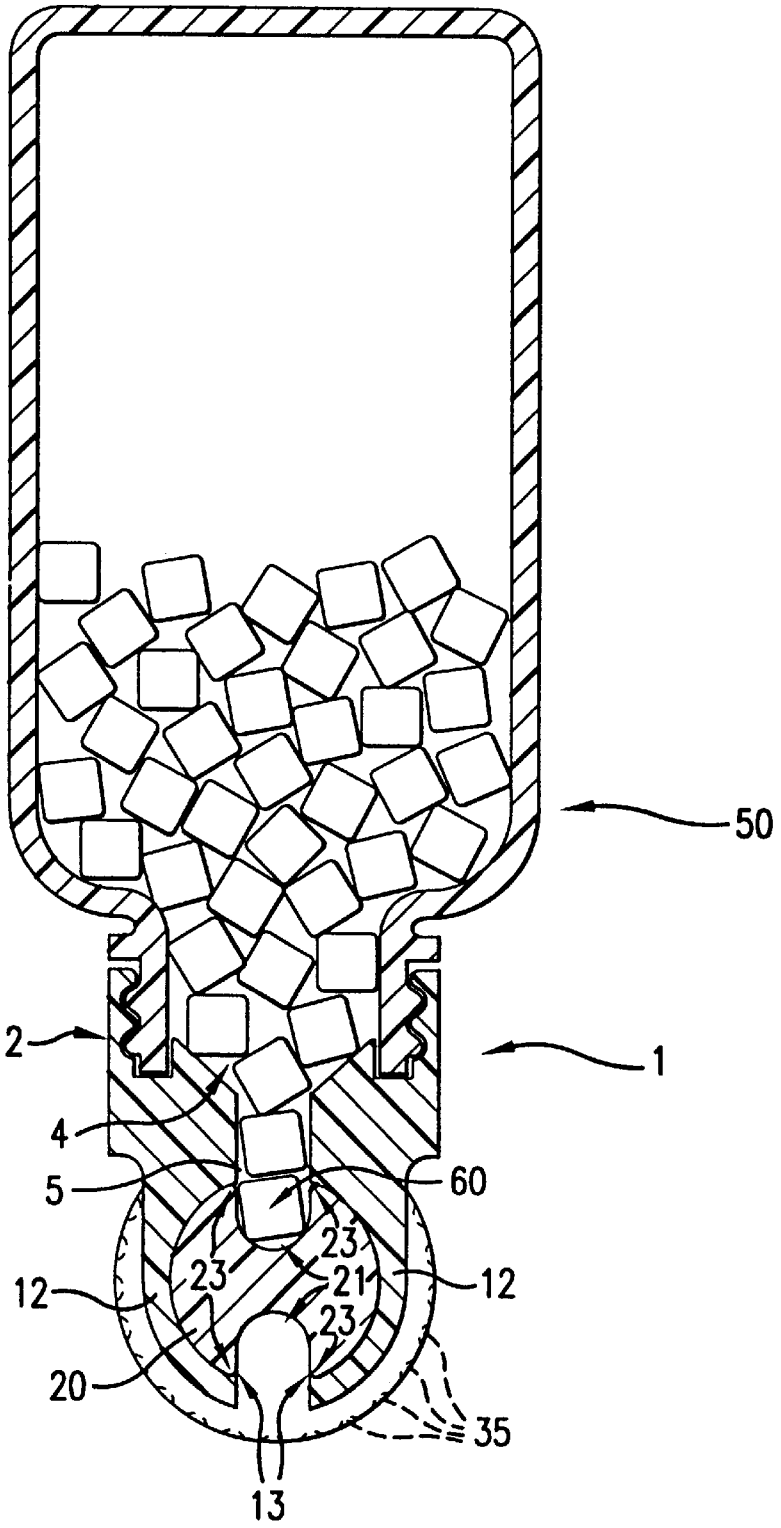
FIGS. 6, 7 and 8 are cross-sections of the invention attached to a container, making it possible to see, progressively, the movement of a tablet inside the dispensing cap.
Figure 7:
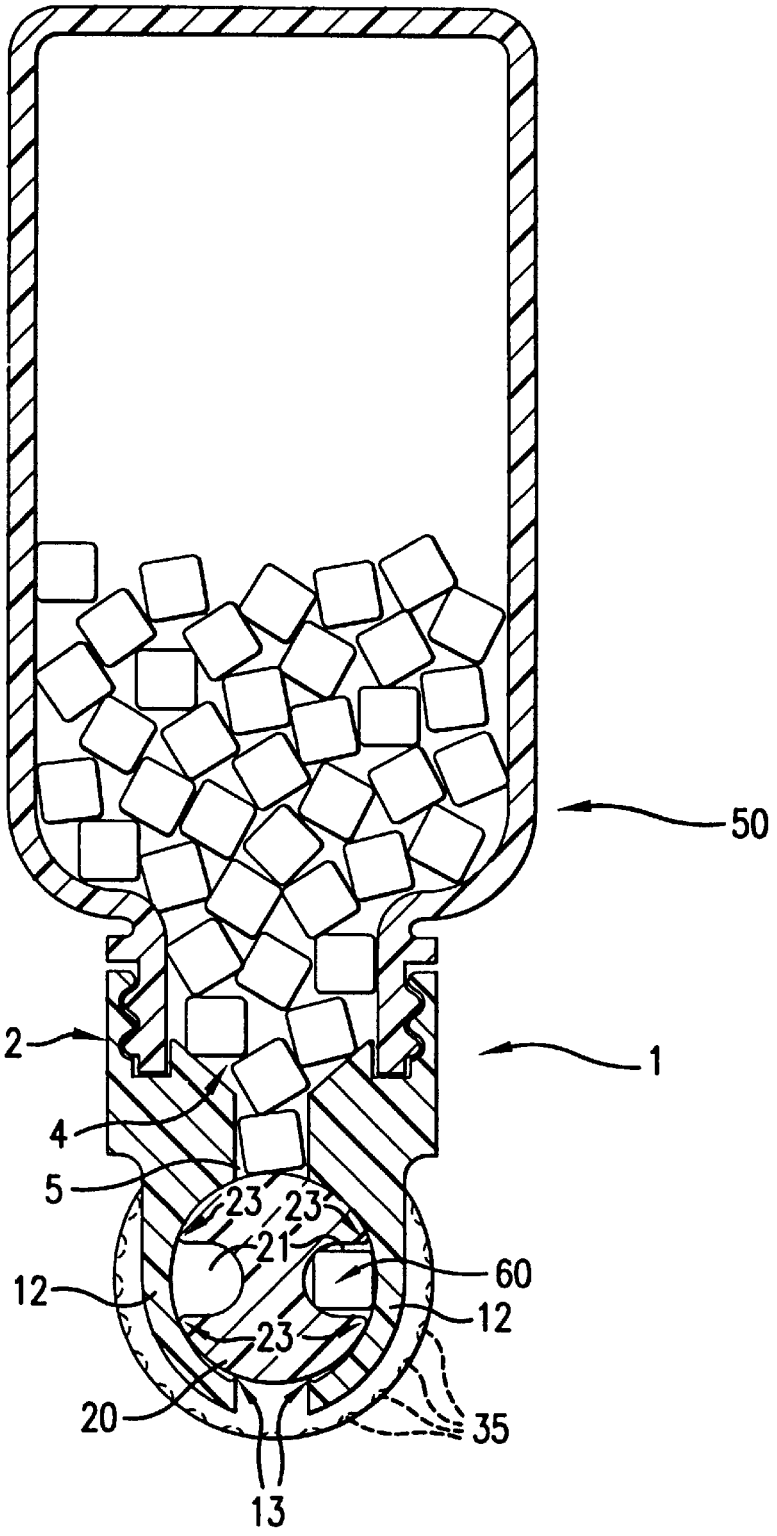
Figure 8:
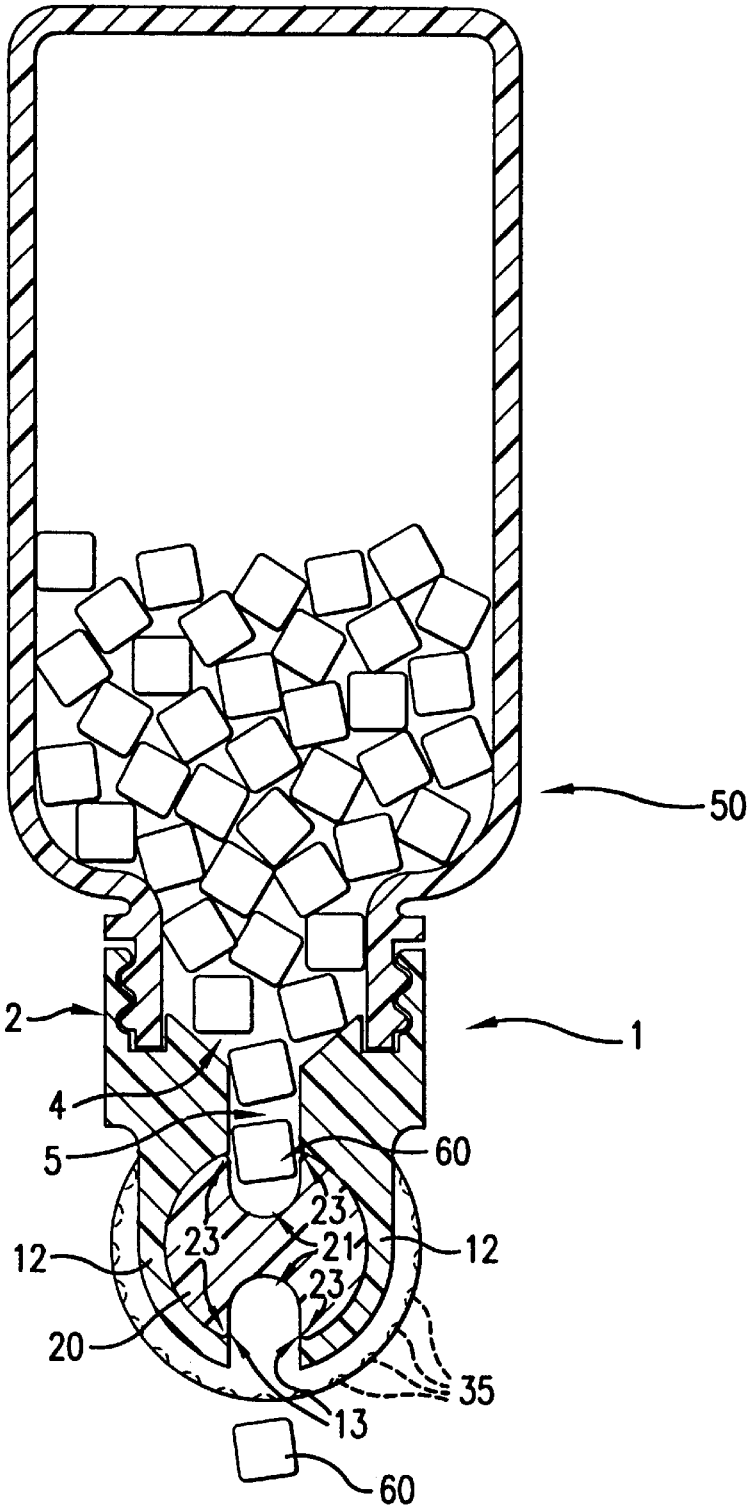

The operation of this tablet dispensing cap is illustrated in FIGS. 6 to 8. Once the cap (1) is attached to a container (50), the container (50) is inverted or inclined sufficiently to cause gravity to move the non-liquid form (60) from the mouth (4) of the base (2) to the channel (5). The scallops (35) on the discs (30) facilitate the user's ability to rotate the discs (30) with one hand. As can be seen in FIG. 6, the discs (30) are rotated until a cavity (21) is aligned with the channel (5). In addition to visually aligning the channel (5) and the cavity (21), the user will know that they are aligned once the rounded edges (23) of the cavity (21) are locked into place by contacting the hooked ends (13) of the spring arm (12).

Once the channel (5) and the cavity (21) are aligned, a single non-liquid form (60) will move into the cavity (21), as illustrated in FIG. 7. Because of the shape of the cavity (21), only a single non-liquid form (60) will fit and therefore only one will be dispensed. Other non-liquid forms (60) in the container (50) cannot enter the cavity (21) and cannot prevent the rotation of the hub (20). After a non-liquid form (60) is in the cavity (21), the discs (30) are rotated 180° and the rounded edges (23) of the cavity (21) are locked into place by contacting the hooked ends (13) of the spring arm (12), as noted above, and the non-liquid form (60) can be dispensed, as illustrated in FIGS. 7 and 8.

The elements described above may be formed of a moldable plastic.

In this disclosure, there is shown and described only the preferred embodiment of the invention, but, as aforementioned, it is to be understood that the invention is capable of changes or modifications within the scope of the inventive concept as expressed herein.

What is claimed is:

1. A cap for dispensing a single non-liquid form comprising:

a circular base having a mouth and a channel, the mouth narrowing into said channel, which is located in the center of the base, the channel being larger in size than the single non-liquid form;

two cantilevered spring arms annularly protruding from the base, away from the mouth, each spring arm terminating in a hooked end;

a circular shaped hub having a plurality of cavities formed on the periphery of the hub, each cavity having rounded edges, said cavity being larger in size than the single, non-liquid form, the hub fitting securely within the annularly positioned spring arms such that the hub and spring arms lie in the same plane and the cavity can be aligned with the channel in the base, the cavity being locked into place when the rounded edges of the cavity are secured by the hooked ends of the spring arms;

two discs, each disc having multiple scallops along the entire periphery of the disc, the discs having a larger diameter than the hub, the center of each disc being attached to the center of one side of the hub such that the disc is parallel to the hub and spring arms and, together, the discs sandwich the hub and the spring arms.

2. The cap, as stated in claim 1, wherein the discs are transparent.

3. The cap, as stated in claim 2, wherein a threaded insert is affixed to the inside of the base.

4. The cap, as stated in claim 2, wherein internal screw threads are on the inside of the base.

5. A process for dispensing a single non-liquid form which comprises using the cap as described in claim 1.

6. The process of claim 5 wherein the non-liquid form is selected from the group consisting of drugs, vitamins, candy or other suitable non-liquid forms whose shape can be accommodated by the cap.

* * * * *